US005216320A

United States Patent [19]

Koizumi et al.

[11] Patent Number: 5,216,320

[45] Date of Patent: Jun. 1, 1993

[54] CATHODE FOR ELECTRON TUBE

[75] Inventors: Sachio Koizumi; Hiroshi Takanobu, both of Mobara; Sadanori Taguchi, Nishitama, all of Japan

[73] Assignee: Hitachi, Ltd., Tokyo, Japan

[21] Appl. No.: 772,500

[22] Filed: Oct. 7, 1991

[30] Foreign Application Priority Data

Oct. 5, 1990 [JP] Japan ..... 2-266214

[51] Int. Cl.[5] ..... H01J 1/14

[52] U.S. Cl. ..... 313/346 R

[58] Field of Search ..... 313/346 R

[56] References Cited

U.S. PATENT DOCUMENTS

| | | | |
|---|---|---|---|
| 4,855,637 | 8/1989 | Watanabe et al. | 313/346 R |
| 4,924,137 | 5/1990 | Watanabe et al. | 313/346 R |
| 4,980,603 | 12/1990 | Kimura et al. | 313/346 R |
| 5,075,589 | 12/1991 | Derks et al. | 313/346 R |

FOREIGN PATENT DOCUMENTS

| | | |
|---|---|---|
| 0091161 | 10/1983 | European Pat. Off. . |
| 0210805 | 2/1987 | European Pat. Off. . |
| 0327074 | 8/1989 | European Pat. Off. . |
| 0390269 | 10/1990 | European Pat. Off. . |
| 271732 | 12/1986 | Japan . |
| 22347 | 1/1987 | Japan . |
| 90819 | 4/1987 | Japan . |
| 146643 | 6/1987 | Japan . |
| 198029 | 9/1987 | Japan . |
| 310535 | 12/1988 | Japan . |
| 310536 | 12/1988 | Japan . |
| 311530 | 12/1989 | Japan . |
| 311531 | 12/1989 | Japan . |
| 2116356 | 9/1983 | United Kingdom . |

*Primary Examiner*—Palmer C. DeMeo

*Attorney, Agent, or Firm*—Antonelli, Terry, Stout & Kraus

[57] ABSTRACT

The present invention improves the stability among the qualities of the electron tube cathodes in which the barium scandate is dispersed and contained in the alkali earth metal oxide layer provided on the surface of the base metal, by making the shape and average particle size of the barium scandate similar to those of the carbonate used to form the alkali earth metal oxide, and it avoids the deterioration of the electron emission property for a long time, by setting the concentration of the barium scandate in the alkali earth metal oxide layer to zero at the position close to the surface of the base metal.

14 Claims, 1 Drawing Sheet

CATHODE FOR ELECTRON TUBE

BACKGROUND OF THE INVENTION

The present invention relates to the cathode for electron tube which features the electron emission property stabilized for a longer time at a high current density.

Higher definition of the color picture tubes, data display tubes and image pickup tubes has come to require the cathodes of these electron tubes to have electron emission property stabilized for a longer time at high current density.

As a means of meeting these requirements, the following proposals have been made to date.

For example, Japanese Patent Laid-Open 61-271732 and Japanese Patent Laid-Open 62-22347 disclose the dispersing of the powdered scandium oxide in a layer of alkaline earth metal oxide mounted on the base metal. The complex oxide $Ba_xSc_yO_z$ formed by the reaction between the scandium oxide and the alkali earth metal oxide (e.g. BaO) is dispersed and contained in the electron emissive material, and the complex oxide undergoes gradual thermal decomposition during the operation of the cathode, forming the excess Ba and BaO, which are emitted into the electron emissive material. Therefore, the concentration of the excess Ba and BaO in the layer of the alkaline earth metal oxide is kept high even after the cathode has been operated for a long time, thereby maintaining the excellent electron emission property.

The Japanese Patents Laid-Open 62-90820, 1-311530 and 1-311531 disclose the complex oxide of barium and scandium dispersed in the layer of the alkaline earth metal oxide.

The Japanese Patents Laid-Open 63-310535 and 63-310536 disclose the scandium oxide dispersed in the layer of alkaline earth oxide which is crystallized in prismatic polyhedron or dodecahedron.

The Japanese Patent Laid-Open 62-198029 discloses that two layers of the electron emissive materials are mounted on the base metal, and one layer on the base metal side is provided with dispersed scandium compound.

In the conventional techniques mentioned above, however, consideration has not been given to the stable mass production of the cathodes.

The present inventors have conducted mass production tests to survey the manufacturing of a cathode for an electron tube by the prior technique using the scandium oxide dispersed and impregnated in the layer of the alkaline earth metal oxide. The inventors have found two problems; (1) a problem that a long time is required for aging which is intended to stabilize the electron emission property, and (2) a problem that it is difficult to disperse the scandium oxide uniformly in the layer of the alkaline earth metal oxide at the predetermined ratio, so that the electron emission properties of the respective electron tubes are different from each other.

Problems have also been found out that the powdered complex oxide of the barium and scandium (barium scandate) dispersed in the layer of the alkaline earth metal oxide cannot be made to be dispersed uniformly in an alkaline earth metal carbonate (this is applied on the base metal and is heated in vacuum, to be made into the oxide), so that the content of barium scandate in the layer varies according to each cathode, and the electron emission properties of the respective tubes become different from each other.

In addition, in the cathode the base metal of which is directly coated with barium scandate layer or an alkaline earth metal oxide layer containing dispersed scandium oxide, the bonding strength between the coated layer and the base metal is reduced during the operation of the cathode, and in an extreme case, the coating layer peels off. These phenomena tend to be more conspicuous with the greater amount of the scandium compound contained in said coating layer.

SUMMARY OF THE INVENTION

The object of the present invention is to solve the problems heretofore described and to provide cathodes for electron tubes which have no quality variation among them, and which can ensure the electron emission property stabilized for a long time at the high current density.

The object of providing cathodes for electron tubes having no quality variation among them can be achieved as follows: in the electron tube cathode having the alkaline earth metal oxide layer provided on a surface of the base metal which is fixed to the cathode sleeve so as to cover one end of said sleeve, the barium scandate particles are dispersed and contained in the alkaline earth metal, oxide layer, and the shape of the barium scandate particles is made to have almost the same shape as that of the particles which is used to form said alkaline earth metal oxide, and average particle size of the barium scandate particles is made to be approximate to that of the carbonate particles.

The average particle size mentioned above is that measured by the well-known Coulter counter method which is based on the Coulter's principle.

The Coulter counter method is a method to measure the particle size in the following way; an aperture tube filled with an electrolyte is immersed in the electrolyte, and electrodes are placed inside and outside the aperture tube with both electrolytes separated by the tube wall having apertures. Under this condition, the voltage is applied across both electrodes, and the current is made to flow between both electrodes through the electrolytes. In this instant, said electrolyte suspending fine particles is sucked through the apertures and the individual particles pass through the apertures. In this case, the electrolyte of the volume corresponding to the particle volume is replaced by fine particles, and the electric resistance between both electrolytes changes. This change of the electric resistance is measured to obtain the measurement of the particle size.

The average content, of the barium scandate particles contained in the alkaline earth metal oxide layer should be greater than 0.01 wt % in terms of $Ba_2Sc_2O_5$, and is lower than 10 wt %. If the barium scandate content is lower than or equal to 0.01 wt % in terms of $Ba_2Sc_2O_5$, the effect of the improved electron emission property cannot be observed. If it is 10 wt % or more in terms of $Ba_2Sc_2O_5$, the electron emissive material layer tends to peel off from the surface of the base metal considerably. Both cases are not favorable.

The carbonate used to form the alkali earth metal oxide particles is in a needlelike shape. The oxide formed from this material also inherits this shape. The barium scandate particles are required to have the shape similar to needlelike shape of the oxide. To be more concrete, it should be rod-shaped, preferably with its length more than 1.4 times it thickness.

The average, particle size $S_1$ of the barium scandate particles measured according to the Coulter counter method is required to be approximate to that of the carbonate used to form the alkaline earth metal oxide, namely, the average particle size $S_2$ of the oxide to be formed therefrom. $S_1$ should preferably satisfy the following formula;

$$0.6<S_1/S_2<1.8$$

If the average particle size $S_1$ of the barium scandate is outside this range, the electron emission properties for the respective cathode tubes become different from each other considerably.

The barium scandate particles can be made by mixing scandium oxide $Sc_2O_3$ with barium carbonate $BaCO_3$ and heating the mixture in the air thereafter. The shape and dimensions of the barium scandate particles obtained in this way is almost the same as those of the starting material, namely, scandium oxide particles. The shape and dimensions of the barium scandate particles can be controlled by using the scandium oxide particles as the starting material having the desired shape and dimensions.

Instead of using the average particle size $S_1$ of the barium scandate particles having the range mentioned above and measured by the Coulter counter method, it is possible to use the length and thickness of the barium scandate particles of the following ranges: when the length and the thickness are assumed to be $L_1$ and $T_1$ respectively, and the length and thickness of the carbonate particles used to form the alkaline earth metal oxide (namely, the length and the thickness of the oxide formed therefrom) are assumed as $L_2$ and $T_2$ respectively, the $L_1$ and $T_1$ may be set to satisfy the following formula;

$$0.2<L_1/L_2<1.9 \text{ and } 0.2<T_1/T_2<6.$$

As the barium scandate particles to be added to the alkaline earth metal carbonate of the layer to be provided on the surface of the base metal, it is effective for the activation of the cathode in the electron tube manufacturing process to use $Ba_2Sc_2O_5$ wherein the constituent ratio of BaO is the highest in terms of the ratio between BaO and $Sc_2O_3$. The constituent ratio of BaO may be reduced by increasing the volume of the $Sc_2O_3$. Theoretically, only the $Sc_2O_3$ may be used, but a long time will be required for aging as discussed above.

In the prior technique mentioned above, the barium scandate particles cannot be uniformly dispersed in the alkaline earth metal oxide. This is due to following reasons; (1) smooth mixing and dispersion is prevented by the difference of the crystal shapes, particle size and specific gravities between the barium scandate particles and the alkali earth metal carbonate particles used to form the alkaline earth metal oxide, and (2) separation and sedimentation proceed when placed and stored under static conditions. Thus, in the present invention, uniform dispersion of the two and its maintenance can be easily achieved by making the shape (rodlike form) and particle size of the barium scandate particles similar to those (needlelike form) of the alkaline earth metal carbonate particles.

The rod-formed crystal of the barium scandate can be obtained by heating the needle-shaped crystal of scandium oxide and barium carbonate at the temperature of 900° to 1100° C. in a nonreducing atmosphere (e.g. in atmosphere). For example, $Ba_2Sc_2O_5$ is formed by heating at the temperature of 1000° C. for 300 hours. If heating temperature exceeds 1000° C., $Ba_3Sc_4O_9$ is also formed.

Furthermore, it is possible to obtain more excellent cathodes featuring excellent property (i.e. an electron emission property that is stable for a long time) by the following structure: the alkaline earth metal oxide containing the barium scandate particles on the surface of the base metal is provided in a plurality of layers, and at least the first layer immediately on the base metal is formed of the alkaline earth metal oxide layer not including the barium scandate, and the layer provided on said first layer is made of the alkaline earth metal oxide layer including the barium scandate.

In this instance, each of the thicknesses of the bottom and top layers should be 4 μm or more. If this is less than 4 μm, the thickness sometimes may be smaller than the thickness of the barium compound crystal undesirably. The amount of the barium scandate particles is usually zero in the first layer (namely, the layer contacting the base metal) on the base metal as described above, and the barium scandate is usually made to be contained in the second layer and upward. Preferably, upper layers (i.e. more outer layers) may have barium scandate particles with higher concentration, i.e. the concentrations of the barium scandate particles increases gradually with an increased in the distinct from the base material. In the electron tube cathode, it is essential to maintain high concentration of the Ba and BaO in the alkaline earth metal oxide layer, as mentioned above. If the more outer layer is provided with a higher concentration of barium scandate particles, the evaporation of the barium can be prevented, and this gives a favorable effect. The concentration of the barium scandate particles on the outermost layer can be up to 25 wt %.

When a plurality of layers of alkaline earth metal oxide is to be provided, the content of the barium scandate should be higher than 0.01 wt % and lower than 10 wt % in terms of $Ba_2Sc_2O_5$ as an average of all the oxide layers on the base metal.

The total thickness of the alkaline earth metal oxide layers is the same as that of the conventional single layer, and can be, but not limited to, 50 μm to 100 μm usually. In the present invention, the thickness is the same as given above, even when the alkaline earth metal oxide consists of a single layer.

When the barium scandate is present in contact with the base metal, the bonding strength between the base metal and the coating layer is reduced for the reasons that the bonding strength between the base metal and the coating layer is normally promoted by the interface layer of barium silicate $Ba_2SiO_4$ which is due to the small amount of Si contained in the base metal and which is formed on the boundary between the base metal and the coating layer, and when the barium scandate dispersed layer is present, the formation of the interface layer of barium silicate is suppressed as disclosed in the Japanese Patent Laid-Open 62-198029, and the peeling is assumed to be caused by the thermal expansion difference and the static force between the base metal and coating layer. By contrast, the present invention makes it possible to ensure to stable life property by providing more than one coating layer so that the scandium compound will not be in direct contact with the base material.

Furthermore, even when the alkaline earth metal oxide layer can be regarded as a single layer substantially, it is possible to get the same effect as when a plurality of layers of alkaline earth metal oxide are provided, by ensuring that the barium scandate is not contained in the portion contacting the base metal so that the barium scandate will not contact the base metal and by ensuring that the more outer layer of the oxide layers will have higher concentration of barium scandate (the outermost layer part can be up to 25 w %). In this instance, the content of the barium scandate should be greater than 0.01 wt % and smaller than 10 wt % in terms of $Ba_2Sc_2O_5$ as an average of all the alkaline earth metal oxide layers on the base metal.

When a plurality or layers of the alkaline earth metal oxide are provided as described above, or when concentration of the barium scandate in the alkaline earth metal oxide layer is higher on the more outer layer, excellent results due to the gradient of the barium scandate content mentioned above can be obtained without controlling the shape and dimensions of the barium scandate particle as described above.

DESCRIPTION OF THE PREFERRED EMBODIMENTS

The following describes the constitution of the electron tube cathodes of the present invention with reference to the preferred embodiments:

EXAMPLE 1

Figure 1:
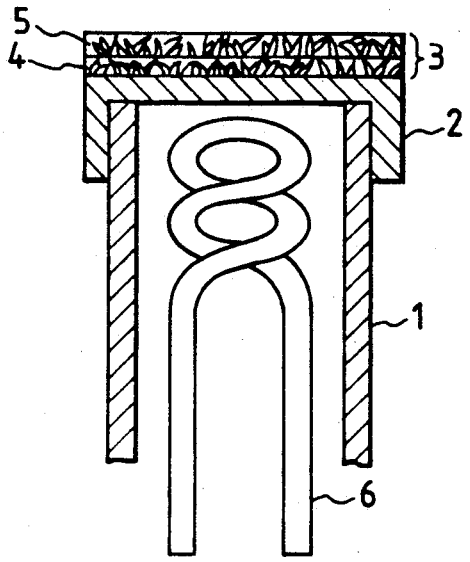
FIG. 1 is a schematic sectional view of the electron tube cathode in an embodiment of the present invention.

FIG. 1 is a sectional view representing the schematic constitution of the electron tube cathode of the present invention, using two electron emissive material layers. It comprises cathode sleeve 1, nickel base metal 2 and electron emissive material layer 3. It shows that the electron emissive material layer 3 further comprises the first layer 4 composed of (Ba, Sr, Ca) $CO_3$ and the second layer 5 composed of (Ba, Ca, Sr) $CO_3$ with dispersed barium scandate of 0.8 wt %. In this case, the barium scandate is made by mixing the scandium oxide ($Sc_2O_3$) of rodlike crystal with the barium carbonate ($BaCO_3$), and heating the mixture in the atmosphere at the temperature of about 1000° C. for 500 hours. The obtained barium scandate particles have the shape and particle size similar to those of the (Ba, Sr, Ca) $CO_3$ crystal; the particle is a rod-formed crystal having a length of about 10 μm and the thickness of about 2 μm. The 80 wt % or more of the obtained barium scandate particles consist of $Ba_2Sc_2O_5$.

The shape and dimensions of the scandium oxide particles used to make the barium scandate particles were approximately the same as those of the obtained barium scandate; the employed barium carbonate was powderlike.

To produce the cathodes, nitrocellulose lacquer of 13 liters and butyl oxalate of 5.6 liters were added to each of the powdered (Ba, Sr, Ca) $CO_3$ and the powdered (Ba, Sr, Ca) $CO_3$ with 0.8 wt % of the barium scandate particles dispersed therein, and were agitated by the ball mill after being made into the suspension of 20 liters, thereby making each suspension uniform. (The former suspension is hereafter referred to as liquid A, while the latter suspension is referred to as liquid B.) Then the first layer 4 was made by applying the liquid A to a thickness of about 35 μm on the nickel base metal 2 by the spray method. In the same way, the second, layer 5 was made by applying the liquid B to a thickness of about 35 μm, on the first layer 4. Thus, the electron emissive material layer 3 was formed. Furthermore, the electron emissive material layer 3 was heated by the heater 6 in the process of gas exhausting for vacuum to decompose the carbonate into the oxide. It was then heated to the temperature of 900°~1100° C. for activation, thereby producing the cathode. The powdered (Ba, Sr, Ca) $CO_3$ was a needle-shaped crystals with a length of about 11 μm and thickness of about 1 μm. It was found out also that the ratio S1/S2 of the average particle size of the barium scandate to that of the oxide measured by the Coulter counter method was about 1.2.

Figure 2:
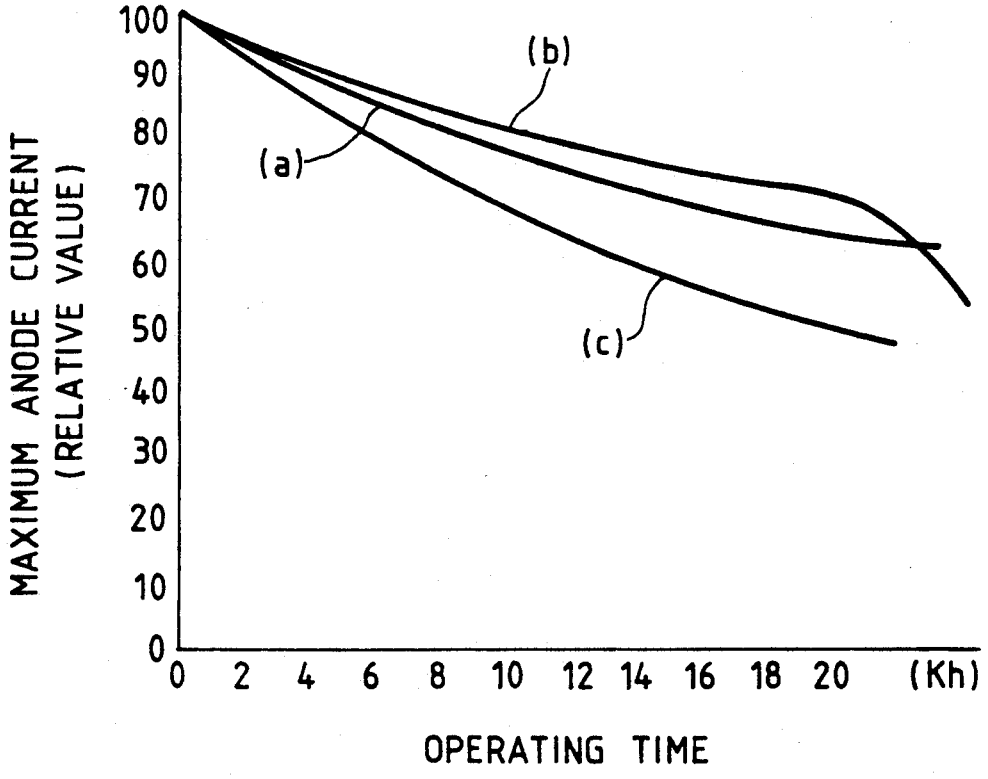
FIG. 2 is a diagram representing the change with the passage of time in the electron emission property of the electron tube cathode in the embodiments of the present invention and that of the conventional electron tube cathode.

The curve (a) in FIG. 2 represents the change with passage of time in the electron emission property when the cathode produced in the manner of the present embodiment mentioned above is mounted on the cathode ray tube. Curve (b) of FIG. 2 represents the change (to be described below in EXAMPLE 2) with the passage of time in the electron emission property when there is a single layer of electron emissive material which is produced by using the (Ba, Sr, Ca) $CO_3$ with 1.6 wt % of barium scandate dispersed therein. Curve (c) in FIG. 2 represents the change with the passage of time in the electron emission property of a prior art in which there is a normal single layer of electron emissive material without barium scandate.

In FIG. 2, the abscissa shows the operating time, while the ordinate represents the maximum anode current.

From this result, it can be known that the property in the case of curve (a) is much better than that in the case of curve (c), and that the property in the case of curve (b) is as good as that in the case of curve (a) in some elapsed time, but is known to show the abrupt deterioration in the final phase of the long-time operation. This feature in the case of curve (b) also appears when the total amount of the $Ba_2Sc_2O_5$ contained in the electron emissive material is set to 10 wt % or more even in the case of comprising two electron emissive material layers, but this phenomenon is due to the peeling of the electron emissive material layer from the nickel base metal. When the amount of the dispersed $Ba_2Sc_2O_5$ is 0.01 wt % or less, the improved effect of the electron emission property is not observed at all.

When the $Ba_2Sc_2O_5$ is made to have the shape and particle size similar to those of the (Ba, Sr, Ca) $CO_3$, dispersion stability in the suspension for spray is so excellent that the content of dispersed $Ba_2Sc_2O_5$ shows the difference of 0.1 wt % or less, between the start and the end of the spraying operation performed (the elapsed time of about eight hours), for example, using 20 liters of the suspension tank. By contrast, when the average particle size between them differs by 40% or more the sedimentation of the $Ba_2Sc_{2O5}$ proceeds conspicuously in the suspension, and the content of the dispersed barium scandate at the end of the operation is 1.5 times that at the start of the operation, under the same condition as the above.

EXAMPLE 2

The cathodes were produced under the same condition as EXAMPLE 1, except that the content of the barium scandate particles was 1.6 wt % and the single layer of alkaline earth metal oxide layer having 70 μm thickness was used. Measuring the change with the passage of time in the electron emission property, there were obtained the results illustrated in curve (b) of FIG. 2. Compared with the conventional case of curve (c), this property in the present example 2 is much more excellent. However, as described in EXAMPLE 1, it showed a sudden deterioration after a long-time operation. The cathode structure of the present embodiment can be shown by making the electron emissive material layer 3 of FIG. 1 a single layer.

EXAMPLE 3

Using the same powdered (Ba, Sr, Ca) $CO_3$ and powdered barium scandate as in the case of EXAMPLE 1, the (Ba, Sr, Ca) $CO_3$ layer without containing the barium scandate was first formed on the nickel base metal. The (Ba, Sr, Ca) $CO_3$ layers respectively containing 0.4 wt %, 0.8 wt %, 1.2 wt % and 2 wt % of the barium scandate were formed on this layer sequentially in that order. The thickness of each layer was 15 μm. Heating was then performed as in EXAMPLE 1, thereby producing the cathode. This was mounted on the cathode ray tube, and the change with the passage of time in the electron emission property was measured. There is obtained the result which was more preferable than that in EXAMPLE 1. The cathode structure of the present embodiment can be shown by making the second layer 5 of FIG. 1 the four layers.

In the example 3, excellent results were also obtained when the concentration of the barium scandate particles contained in the alkaline earth metal layer was changed almost continuously from 0 wt % to 2 wt % from on the surface of the nickel base metal. In this case, the oxide layer is composed of a single layer.

As discussed above, the use of the electron tube cathode of the present invention is shown to have solved problems of the conventional techniques, and the present invention provides electron tube cathodes with stable, uniform quality which ensure an electron emission property that is stabilized for a long time at high current density.

What is claimed is:

1. A cathode for an electron tube having an alkaline earth metal oxide layer on a surface of a base metal fixed to a cathode sleeve to cover one end of said sleeve, wherein barium scandate particles are dispersed and contained in said alkaline earth metal oxide layer and the concentration of the barium scandate particles in said alkaline earth metal oxide layer is zero at a portion contacting said base metal, the barium scandate particles showing gradual increase in concentration with an increasing in distance from said base metal.

2. A cathode for an electron tube according to claim 1, wherein the barium scandate particles have a shape similar to that of particles of an alkaline earth metal carbonate used to form said alkaline earth metal oxide layer and the particles of barium scandate have an average particle size similar to that of the particles of the alkaline earth metal carbonate.

3. A cathode for an electron tube according to claim 2, wherein the barium scandate particles have a rodlike shape with a length 1.4 times or more the thickness.

4. A cathode for an electron tube according to claim 3, wherein the average particles size $S_1$ of said barium scandate particles measure by the Coulter counter method satisfies the following relationship:

$$0.6 < S_1/S_2 < 1.8$$

wherein the average particle size, measured by said Coulter counter method, of said alkaline earth metal carbonate used to form the alkaline earth metal oxide is $S_2$.

5. A cathode for an electron tube according to claim 3, wherein the length $L_1$ and thickness $T_1$ of said barium scandate particles respectively, satisfy the following relationships:

$$0.2 < L_1/L_2 < 1.9 \text{ and } 0.2 < T_1/T_2 < 6$$

where the length of said alkaline earth metal carbonate particles used to form the alkaline earth metal oxide layer is $L_2$ and the thickness is $T_2$.

6. A cathode for an electron tube according to claim 1, wherein the average content of said particles of barium scandate in said alkaline earth metal oxide layer is greater than 0.01 wt % and smaller than 10 wt %.

7. A cathode for an electron tube according to claim 6, wherein the content of said particles of barium scandate in the outermost part of said alkaline earth metal oxide layer is smaller than 25 wt %.

8. A cathode for an electron tube having a plurality of alkaline earth metal oxide layers on a surface of a base metal which is fixed to a cathode sleeve to cover one end of said sleeve, wherein a layer contacting said base metal does not include barium scandate and wherein at least one layer of said alkaline earth metal oxide layers is provided on said layer contacting said base metal and said at lest one layer of the alkaline earth metal oxide layers contains dispersed barium scandate particles.

9. A cathode for an electron tube according to claim 8, wherein the thickness of said layer contacting said base metal is 4 μm or more.

10. A cathode for an electron tube according to claim 9, wherein an outermost layer of said plurality of alkaline earth metal oxide layers is 4 μm thick or more.

11. A cathode for an electron tube according to claim 10, wherein the number of said alkaline earth metal oxide layers is 2.

12. A cathode for an electron tube according to claim 8, wherein said each layer of said plurality of alkaline earth metal oxide layers contains a greater amount of said barium scandate particles with an increasing distance from said base metal.

13. A cathode for an electron tube according to claim 12, wherein the average content of said barium scandate particles in said plurality of alkaline of earth metal oxide layers is greater than 0.01 wt % and small than 10 wt %.

14. A cathode for an electron tube according to claim 13, wherein the content of said barium scandate particles in the outermost layer of said plurality of alkaline earth metal outside layer is smaller than 25 wt %.

* * * * *